US005858166A

United States Patent [19]

James et al.

[11] Patent Number: 5,858,166

[45] Date of Patent: Jan. 12, 1999

[54] MACHINE FOR ATTACHING HANDLES TO A GIFT BOX

[76] Inventors: Donald R. James, 18 Cypress Point, Cummaquid, Mass. 02637; Bill Anderson, 23 Elliott St., Centerville, Mass. 02634

[21] Appl. No.: 738,249

[22] Filed: Oct. 28, 1996

[51] Int. Cl.[6] ..... B31B 1/86

[52] U.S. Cl. ..... 156/443; 156/556; 156/566; 156/567; 493/221; 493/226; 493/926

[58] Field of Search ..... 156/443, 566, 156/567, 556; 493/226, 221, 88, 926, 909, 210, 212, 379, 223, 383, 384; 53/413, 134.1

[56] References Cited

U.S. PATENT DOCUMENTS

| | | | |
|---|---|---|---|
| 1,762,857 | 6/1930 | Eaton | 493/226 X |
| 2,075,672 | 3/1937 | Stark | 493/226 X |
| 2,224,040 | 12/1940 | Eaton et al. | 493/226 X |
| 2,379,087 | 6/1945 | Katz | 493/926 X |
| 3,424,067 | 1/1969 | Blair | 156/440 X |
| 3,607,563 | 9/1971 | Bagnall | 156/439 |

*Primary Examiner*—Jeff H. Aftergut
*Attorney, Agent, or Firm*—Steven N. Fox, Esq.

[57] ABSTRACT

The present invention is a machine for use in attaching first and second handles to a gift box. Each of the first and second handles having first and second end portions and an upper portion. In one embodiment, the machine comprises a base member and first and second side walls extending upward therefrom. The machine further comprises first and second handle support members rotatably connected with the first and second side walls and each being adapted to retain the first and second handles, respectively. The first and second handle support members are operable from a first and normally horizontal position wherein the handles may be inserted thereon and provided with an adhesive to a second substantially vertical position wherein the handles may be attached to the gift box.

6 Claims, 8 Drawing Sheets

MACHINE FOR ATTACHING HANDLES TO A GIFT BOX

FIELD OF THE INVENTION

The present invention relates to the field of gift boxes having handles. More particularly, the present invention relates to machines for attaching handles to gift boxes.

BACKGROUND OF THE INVENTION

Gifts boxes and/of bags typically have one or more handles to allow a person to carry the gift box. A variety of handles have been used in connection with such gift boxes, including flat handles, small diameters strings, and cords. Conventionally, such handles have been attached to the gift box by a variety of means, including the handle being formed as part of the gift box itself or connected through holes provided in the gift box, or attached by a strap which is adhesively attached to the gift box. Such conventional gift boxes are unattractive to consumers and the machines and processes used to manufacture the same are time-consuming, inefficient, and costly.

SUMMARY OF THE INVENTION

One object of the present invention is to provide an improved machine and system for attaching handles to a gift box.

Another object of the present invention is to provide a gift box having a handle which is attached to a gift box in a manner which is aesthetically pleasing appearance to potential shoppers and/or users of the gift box.

The present invention is a machine for use in attaching first and second handles to a gift box. Each of the first and second handles have first and second end portions and an upper portion. In one embodiment, the machine comprises a base and first and second side walls extending upward therefrom. The machine further comprises a first and second handle support members rotatably connected with the first and second side walls and each being adapted to retain the first and second handles, respectively. The first and second handle support members are operable from a first and normally horizontal position wherein the handles may be inserted thereon and provided with an adhesive to a second substantially vertical position wherein the handles may be attached to the gift box.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
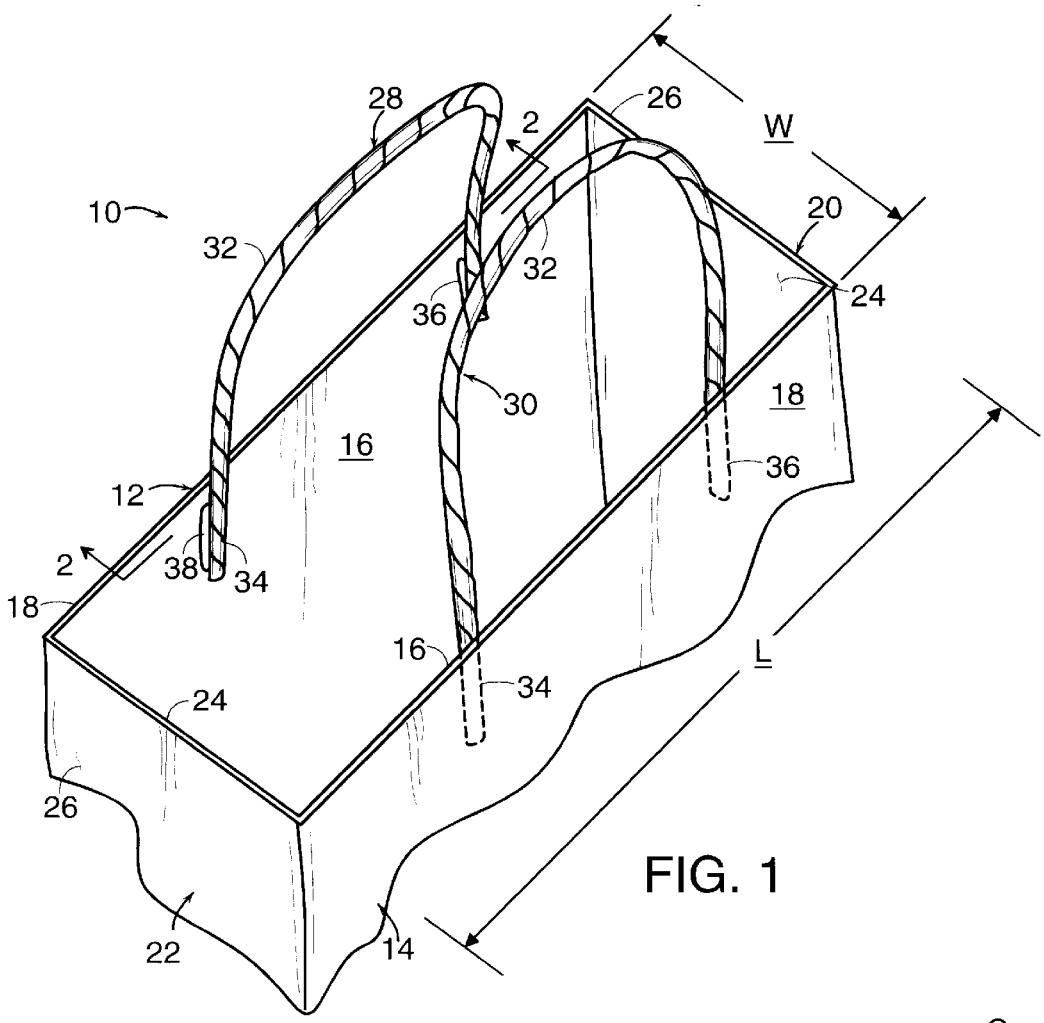
FIG. 1 is a perspective view of the gift box of the present invention showing the first and second handles mounted to the gift box.
Figure 2:
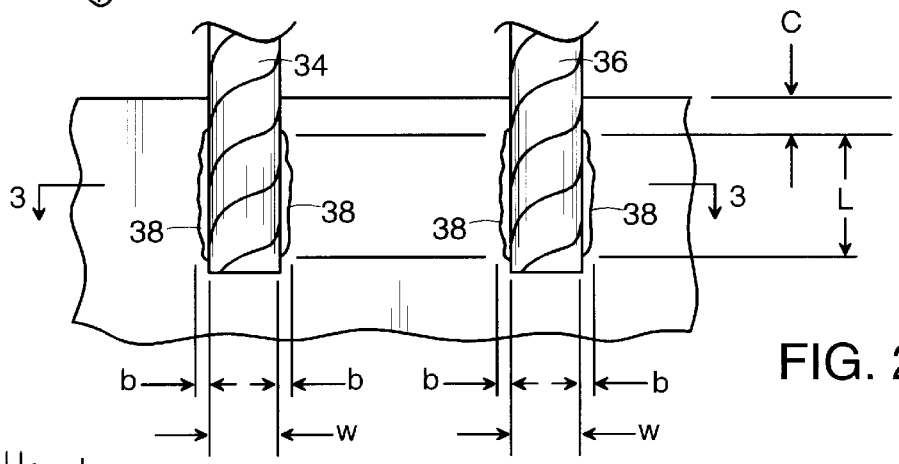
FIG. 2 is a cross-section view taken along line 2—2 of FIG. 1.
Figure 3:
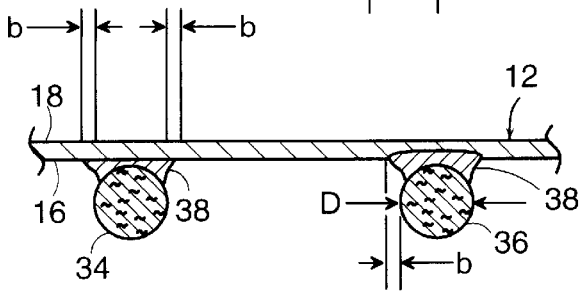
FIG. 3 is a cross-section view taken along line 3—3 of FIG. 1.

Referring to FIGS. 1–3, wherein the gift box or bag 10 of the present invention is shown comprising a first sidewall 12 and a second sidewall 14 each having an inside surface 16 and an outside surface 18. The gift box 10 further comprises a first end wall 20 and a second end wall 22 each having an inside surface 24 and an outside surface 26. The gift box 10 is further defined by an overall width W and an overall length L. The gift box 10 further comprises a first handle 28 and a second handle 30 each having an upper portion 32, a first end portion 34 and a second end portion 36. Each of the first end portions 34 and second end portions 36 are further defined by a width W length L, and a diameter D. The width W should be equivalent to diameter D except after attachment wherein the diameter may be compressed. Diameter D is preferably between the range of ⅛ to ¼ inches while the length L is preferably in the range of ½ to 2.0 inches. These dimensions are important so as to provide an aesthetically pleasing and attractive gift box 10. The gift box 10 further comprises an adhesive member 38 to securely attach the first and second end portions 34 and 36 of handles 28 and 30 to the inside surface 16 of sidewalls 12 and 14, respectively. The adhesive member 38 is disposed between the end portions 34 and 36 and the inside surfaces 16 of sidewalls 12 and 14 such that it does not extend outward more than a distance b from the side edges of the end portions 34 and 36. It is important that distance b as small as possible (preferably zero) and not greater than ⅛ inch in order to provide an aesthetically pleasing and attractive appearance for the gift box 10. The gift box or bag 10 may be made from a variety of materials and processes. By way of example only, the gift box 10 be a foldable gift box having rigid walls and made from a cardboard material. The handle 10 is preferably of substantially round diameter in order to provide an aesthetically and attractive gift box 10 and may be made from a variety of materials such as wound cord or solid plastic.

Figure 4:
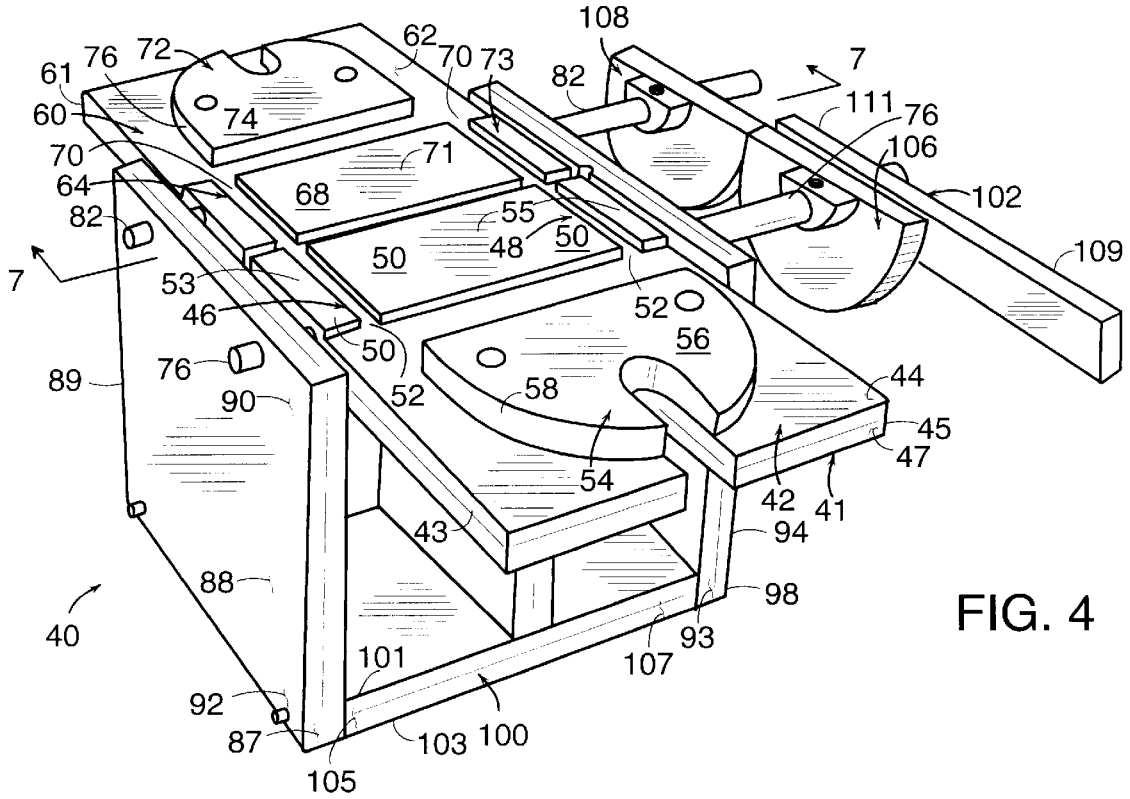
FIG. 4 is a perspective view showing a first embodiment of the handle support machine of the present invention without the first and second handles mounted thereon.
Figure 5:
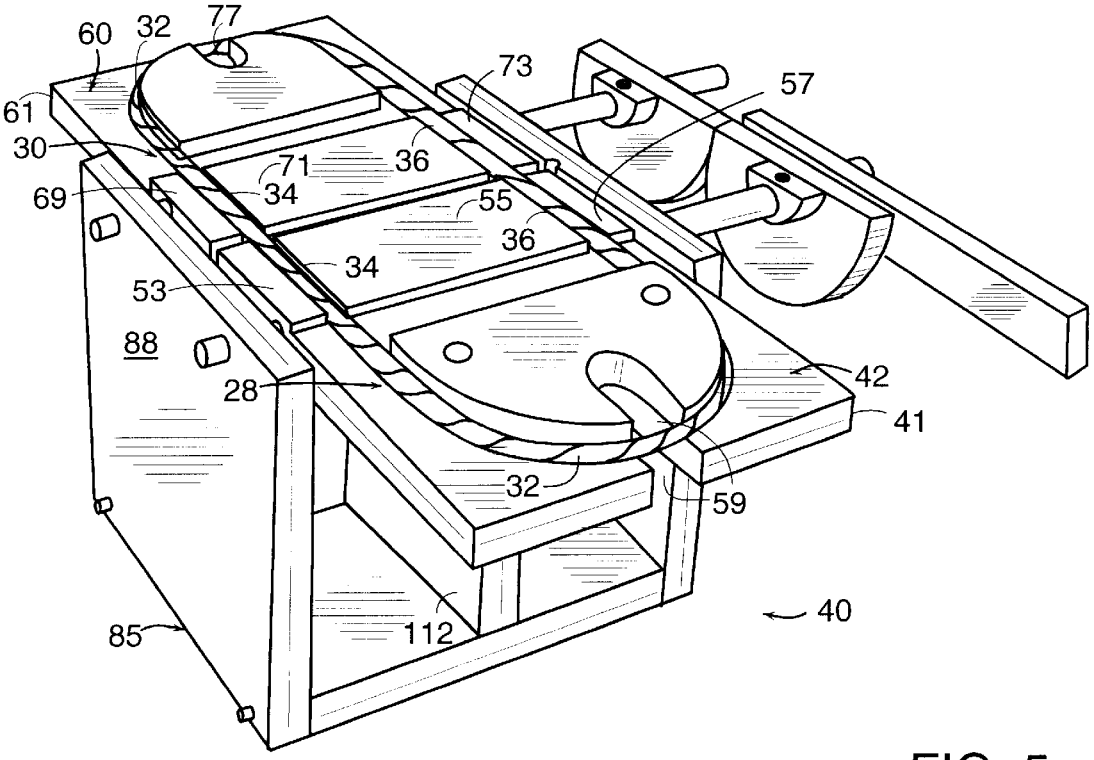
FIG. 5 is a perspective view of the handle support machine of FIG. 4 showing the first and second handle support members in their first normally horizontal position having the first and second handles retained therein and ready to receive an adhesive material prior to attachment to the gift box.
Figure 6:
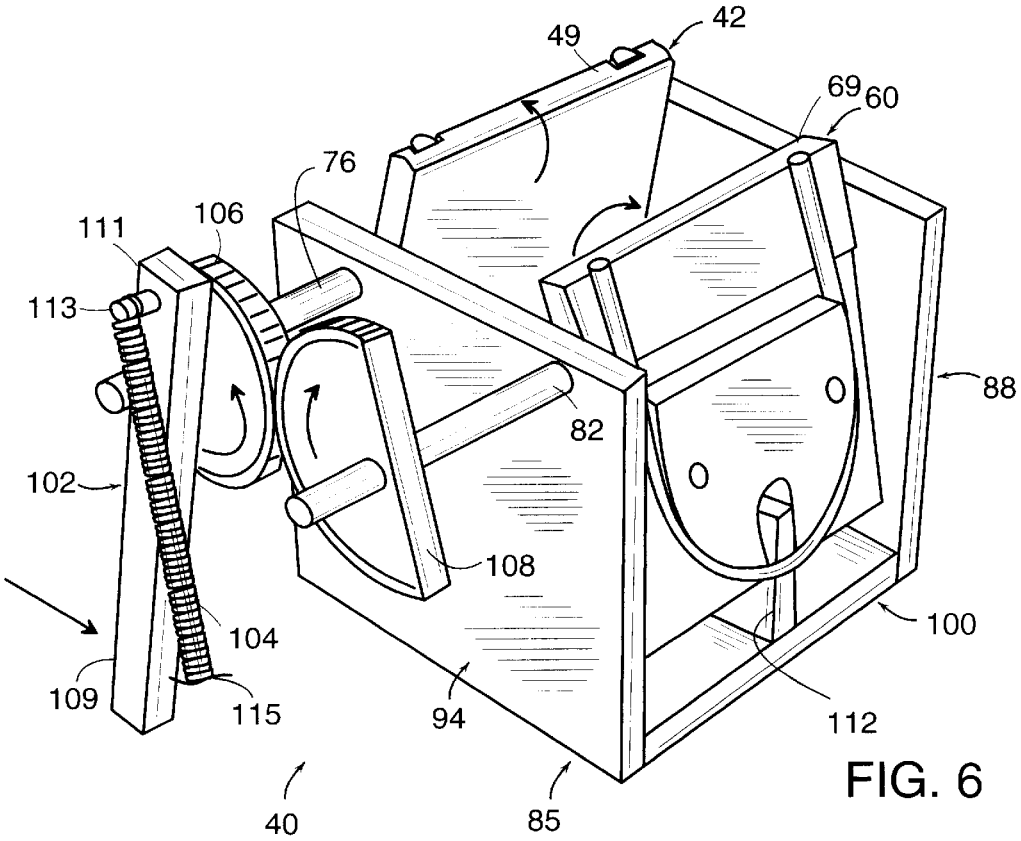
FIG. 6 is a perspective view of the handle support machine of FIG. 5 showing the first and second handle support members in the second substantially vertical position wherein the first and second handles can be attached to the gift box.
Figure 7:
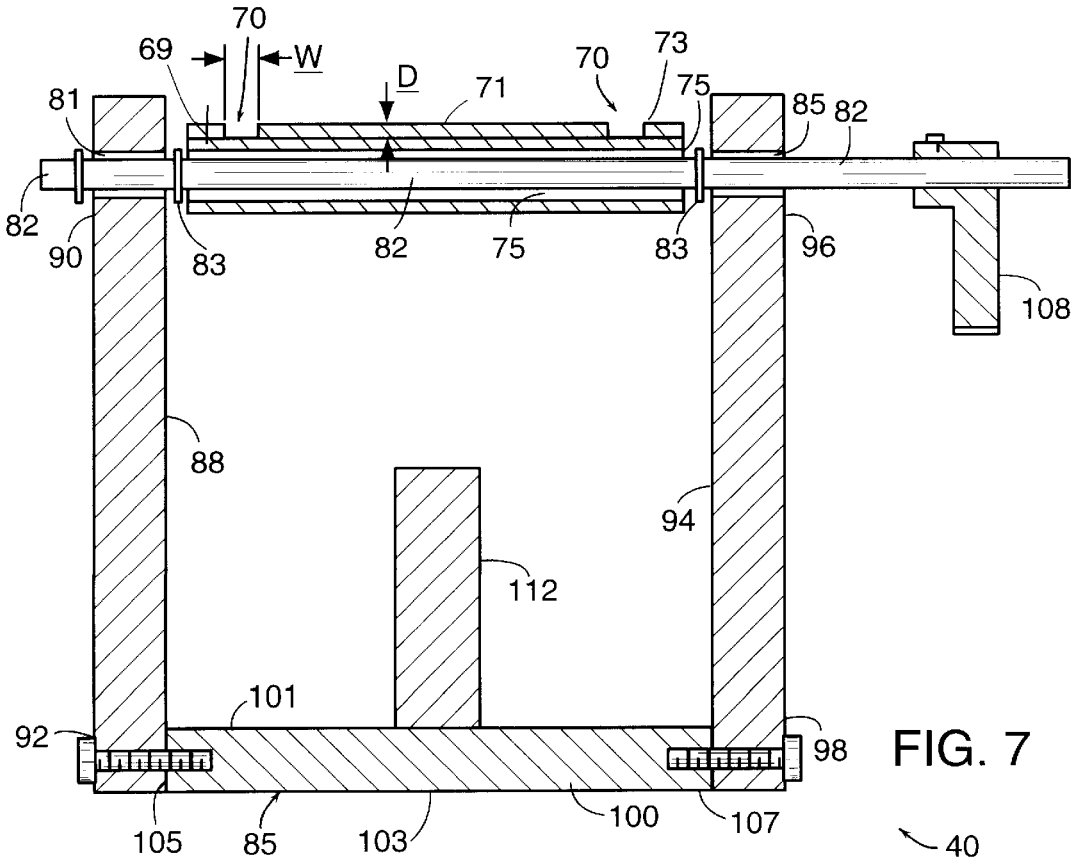
FIG. 7 is a cross-section view taken along line 7—7 of FIG. 4.

Referring to FIGS. 4–7, where the handle support machine 40 of the present invention is shown. The machine 40 is generally used to retain, support and position the handles 28 and 30 for attachment to the inside surface 16 of sidewalls 12 and 14 of the gift box 10. FIG. 4 shows the machine 40 without the handles 28 and 30. FIG. 5 shows the handles 28 and 30 retained within the machine 40 and ready to receive the adhesive member 38 prior to attachment to the gift box 10. FIG. 6 shows the machine 40 depicted in a position whereby the handles 28 and 30 may be brought into contact with and attached to the inside surfaces 16 of the gift box 10.

The machine 40 generally comprises a first handle support member 42 and a second handle support member 60. Support members 42 and 60 are generally adapted to retain the handles 28 and 30, respectively.

Support member 42 comprises a plate 41 having a support surface 44, sidewalls 43 and 45, and end walls 47 and 49. The support member 42 further comprises a first end handle retention portion 46, a second end handle retention portion 48, and an upper handle retention portion 54. The first and second end handle retention portions 46 and 48 are generally adapted to retain first and second ends portions 34 and 36 of the first handle 28, respectively. The upper handle retention portion 54 is generally adapted to retain the upper portion 32 of the first handle 28.

Each of the first and second end handle retention portions 46 and 48 comprise a channel or elongated recess 52 adapted to allow the end portions 34 and 36, respectively, of the first handle 28, to be inserted and retained therein under tension and to be removed therefrom without significant force. Each of the channels 52 is defined by a width W, a length L, and a depth D. The width W of the channels 52 are preferably slightly smaller than diameter D of the end portions 34 and 36, respectively, of the first handle 28, so that the end portions 34 and 36 may be inserted and retained therein under slight tension and may be removed therefrom without significant force. The depth D of the channel 52 is chosen such that the top surface of the end portions 34 and 36 will extend above the channel 52 so that an adhesive may be applied to the top surface of the end portions 34 and 36. In one embodiment, the channels 52 are formed by an end plate 53, a central plate 55 and an end plate 57 each having a top surface 50. The end plate 53 and central plate 55 are spaced apart to form one of channels 52 while the end plate 57 and central plate 55 are spaced apart to form the other channel 52. The plates 53, 55 and 57 are securely attached to the support surface 44 of plate 41 by conventional means such as bolts to thereby fix the width W of each channel 52. However, each of end portion retention portion 46 and 48 may be adapted such that the width W of the channels 52 may be adjusted or varied. This may be very important because the diameter D of the end porions 34 and 36 of the first handle 28 vary slightly from purchase lot to purchase lot. As such, a channel 52 having an adjustable width W would be able to accomodate such stock variations thereby avoiding any problems with the end portions being loosely conatined within the channel 52. By way of example only, a spring mechanism could be provided so as to normally bias (urge or move) the end plates 53 and 55 inward toward the central plate 57. Movement of the end plates 53 and 57 outward from the central plate 55 would increase the width W of each channel 52. Thereafter, the end portions 34 and 36 of the first handle 28 could be inserted into the channels and upon release of the end plates 53 and 57, the spring mechanism would urge or move the end plates 53 and 57 into contact with the end portions 34 and 36 and secure the same against the central plate 55. The spring mechanism could be design with an appropriate spring force so as to retain the end portions 34 and 36 under slight tension and allow removal therefrom without significant force.

The upper handle retention portion 54 comprises a support member 56 having an outside curved surface 58. The upper portion 32 of the first handle 28 is adapted to fit around and be in substantial contact with the outside surface 58 thereby retaining and giving shape to the upper portion 32 of the first handle 28. The upper handle retention portion 54 may be formed as part of the support surface 44 or connected thereto by conventional means such as screws or bolts.

Support member 42 further comprises a recessed portion 59 extending through the support member 56 and support surface 44. The recessed portion 59 is adapted to allow the upper portion 32 of the first handle 28 to come in contact with a stop member 112 (to be described) when the support member 42 is moved to its vertical position wherein the stop member 112 tends to push and/or dislodge the upper portion 32 from upper handle retention portion 54. In the embodiment shown, the recessed portion 59 is U-shaped.

Support member 60 comprises a plate 61 having a support surface 62, sidewalls 63 and 65, and end walls 67 and 69. The support member 60 further comprises a first end handle retention portion 64, a second end handle retention portion 66, and an upper handle retention portion 72. The first and second end handle retention portions 64 and 66 are generally adapted to retain first and second ends portions 34 and 36 of the second handle 30, respectively. The upper handle retention portion 72 is generally adapted to retain the median portion 32 of the second handle 30.

Each of the first and second end handle retention portions 64 and 66 comprise a channel or elongated recess 70 adapted to allow the end portions 34 and 36, respectively, of the second handle 30, to be inserted and retained therein under tension and to be removed therefrom without significant force. Similar to channels 52, each of the channels 70 is defined by a width W, a length L, and a depth D. The width W of the channels 70 are preferably slightly smaller than diameter D of the end portions 34 and 36, respectively, of the second handle 30, so that the end portions 34 and 36 may be inserted and retained therein under small tension and may be removed therefrom without significant force. The depth D of the channel 70 is chosen such that the top surface of the end portions 34 and 36 will extend above the channel 70 so that an adhesive may be applied to the top surface of the end portions 34 and 36. In one embodiment, the channels 70 are formed by an end plate 69, a central plate 71 and an end plate 73 each having an upper surface 68. The end plate 69 and central plate 71 are spaced apart to form one of channels 70 while the end plate 73 and central plate 69 are spaced part to form the other channel 70. The plates 69, 71, and 73 are securely attached to the support surface 62 of plate 61 by conventional means such as bolts to thereby fix the width W of each channel 70. However, similar to the end portion retention portion 46 and 48 as described heretofore, each of end portion retention portion 64 and 68 may be adapted such that the width W of the channels 52 may be adjusted or varied. Byway of example only, a spring mechanism could be provided so as to normally bias (urge or move) the end plates 69 and 73 inward toward the central plate 71. Movement of the end plates 69 and 73 outward from the central plate 71 would increase the width W of each channel 70. Thereafter, the end portions 34 and 36 of the second handle 30 could be inserted into the channels 70 and upon release of the end plates 69 and 73, the spring mechanism would urge or move the end plates 69 and 73 into contact with the end portions 34 and 36 and secure the same against the central plate 71.

Support member 60 further comprises a recessed portion 77 extending through the support member 74 and support surface 62. The recessed portion 77 is adapted to allow the upper portion 32 of the second handle 28 to come in contact with a stop member 112 (to be described) when the support member 60 is moved to its vertical position wherein the stop member 112 tends to push and/or dislodge the upper portion 32 from the upper handle retention portion 72. In the embodiment shown, the recessed portion 77 is U-shaped.

The machine 40 further comprises a frame 85 generally adapted to support and allow operation of the support members 42 and 60. In the embodiment shown, the frame 85 generally comprises first and second sidewalls 88 and 94 extending upward from a base member 100. Sidewall 88 comprises an upper portion 90, a lower portion 92 and end portions 87 and 89. Sidewall 94 comprises an upper portion 96, a lower portion 98, and end portions 93 and 95. Base member 100 comprises an upper surface 101, a lower surface 103, and side portions 105 and 107. The lower portions 92 and 98 of the first and second sidewalls 88 and 94 are connected by conventional means to the side portions 105 and 107 of the base member 100. The lower surface 103 is adapted to allow the machine 40 to be mounted to a variety of external structures such as a work bench or an index wheel 118 (to be described) which may be part of an overall manufacturing system 114 (to be described).

The machine 40 further comprises means for rotatably connecting the support members 42 and 60 to sidewalls 88 and 94. A first support rod 76 is provided which extends through a clearance hole 73 provided within the support member 42. Although not shown, the support member 42 is securely attached and/or engaged to the support rod 76 at mounting portions 78 and 80 of the support rod 76 by conventional fastener means such as keys and/or screws so that rotation of the support rod 76 causes rotation of the support member 42. The support rod 76 is mounted within clearance holes 79 and 81 provided within the upper portions 90 and 96 of sidewalls 88 and 94 so as to provide free rotation. A washer and/or spacer 83 may be provided to minimize any vibration caused by the support member 42 contacting the upper portions 90 and 96 of sidewalls 88 and 94.

Similarly, a second support rod 82 is provided which extends through a clearance hole 75 provided within the support member 60. The support member 60 is securely attached and/or engaged to the support rod 82 at mounting portions 84 and 86 of the second support rod 82 by conventional fastener means such as keys or screws so that rotation of the second support rod 82 causes rotation of the support member 60. The second support rod 76 is rotatably mounted within clearance holes 83 and 85 provided within the upper portions 90 and 96 of sidewalls 88 and 94 so as to provide free rotation. Although not shown, a washer and/or spacer may be provided to minimize any vibration caused by the support member 60 contacting the upper portions 90 and 96 of sidewalls 88 and 94.

The machine 40 further comprises means for rotating the first and second supports rods 76 and 78 and thereby the support members 42 and 60 from the normally and substantially horizontal position to a second and substantially vertical position whereby the handles 28 and 30 may be attached to the gift box 10. Such means may comprise a variety of manual and/or automated processes. In the embodiment shown, such means comprises a first gear member 106 securely connected to the first support rod 76 and a second gear member 108 securely connected to the second support rod 78. First gear member 106 is engageable with second gear member 108 such that movement and/or rotation of the first gear member 106 (and thereby support member 42) causes movement and/or rotation of the second gear member 108 (and thereby support member 60). The machine 40 further comprises an actuation handle 102 having a first end 109 and a second end 111 connected to the first support rod 76. When first end 109 of actuation handle 102 is lowered, the first support rod 76 is caused to rotate thereby causing first gear member 106 to rotate and engage with second gear member 108 which in turn causes the second support rod 83 and support member 60 to rotate. The machine 40 further comprises a spring member 104 having one end 113 connected to the second end 111 of the actuation handle 102 and adapted to return the actuation handle 102 to its normal position. Although not shown, the other end 115 of the spring member 104 would be connected to a support surface disposed below the actuation handle 102 to thereby provide a resistance to the lowering of the first end 109 of the actuation handle 102 and upon release to return the same its normal position.

The machine 40 further comprises means for ejecting the handle 28 and 30 from the support members 42 and 60. In the embodiment shown, such means generally comprise a stop member 112 mounted upon the upper surface 101 of the base member 100. When the support member 42 and 60 are rotated to their operable position (vertical in the embodiment shown), the recessed portions 59 and 77 pass over the stop member 112 and the median portions 32 of the handles 28 and 30 are brought into contact with the stop member 112 and are caused to be ejected from the upper handle retention portions 54 and 72 of the support member 42 and 62.

Figure 8:
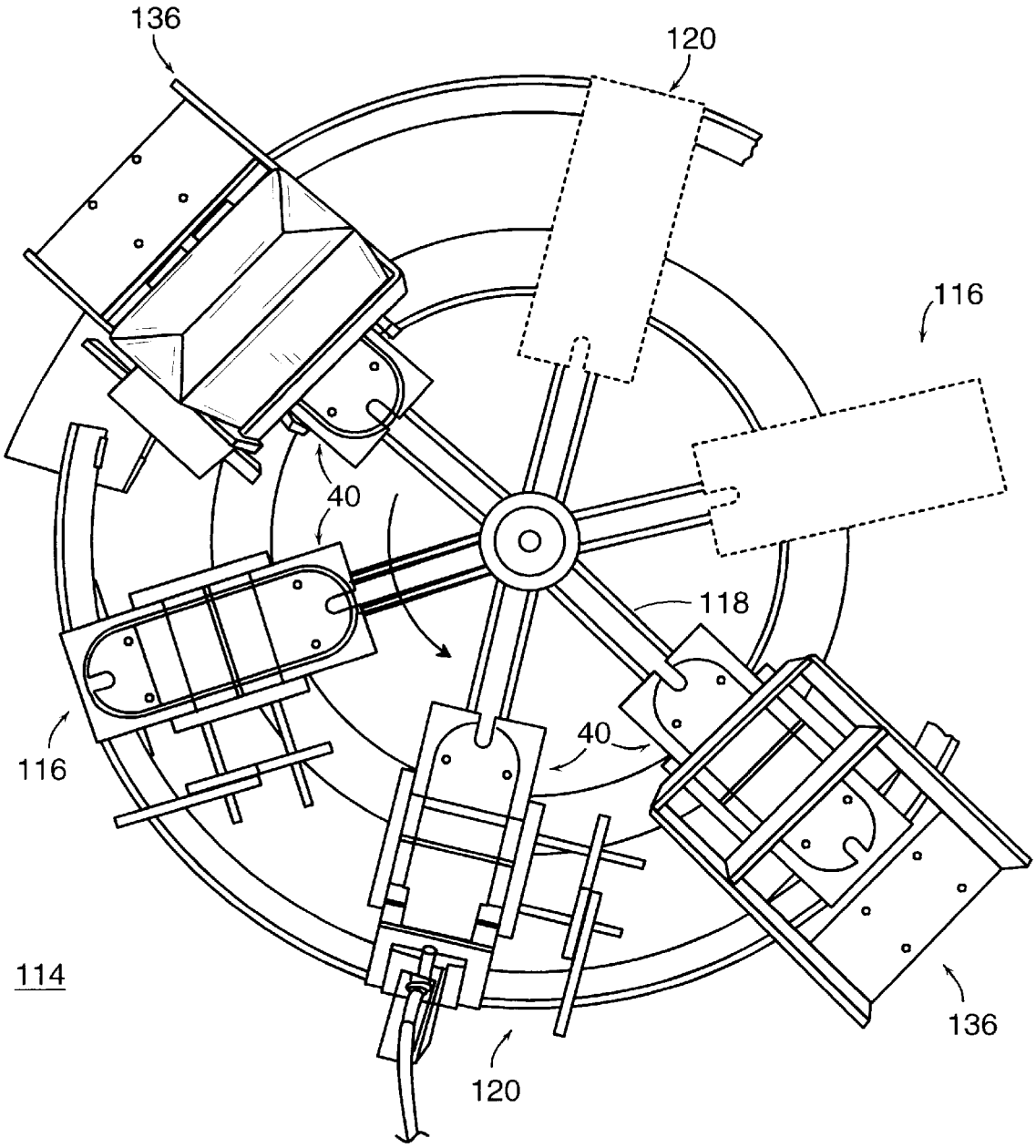
FIG. 8 is top plan view of one embodiment of the manufacturing system of the present invention showing a plurality of handle support machines mounted on an indexing wheel and positioned at a handle insertion station, an adhesive application station, and a handle attachment station.

Referring to FIG. 8 whereby the machine 40 is shown as part of a manufacturing system 114. The system 114 generally comprises a plurality of machines 40 mounted upon an index wheel 118. The index wheel 118 is driven by conventional means such as air compression system and controllable by conventional means. Each of machines 40 are carried and/or moved by the index wheel 118 from a handle loading station 116 where handles 28 and 30 are inserted onto the machine 40, to an adhesive application station 120 where an adhesive is applied to the ends portions 34 and 36 of the handle 28 and 30, to a handle attachment station 136 where the handles 28 and 30 are attached to the gift box 10.

Figure 9:
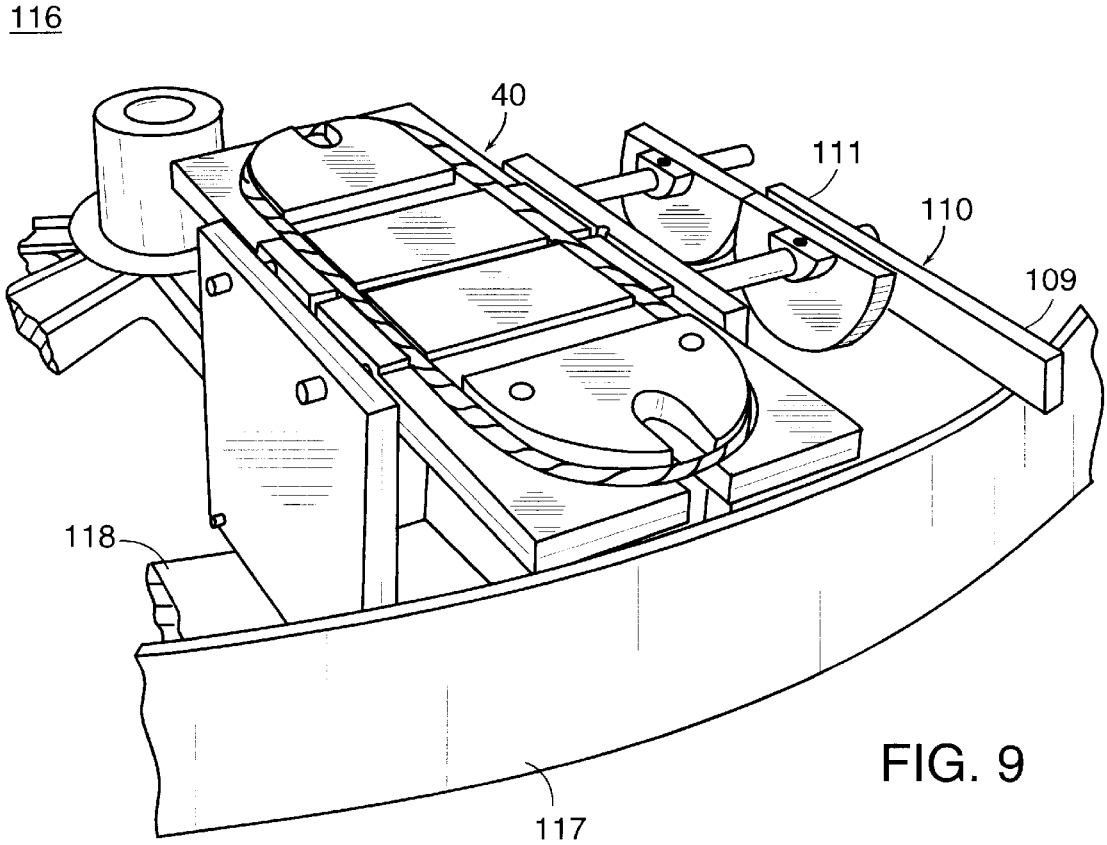
FIG. 9 is a perspective view showing the handle support machine positioned at the handle insertion station of the manufacturing system wherein the first and second handles are inserted onto the first and second handle support members.

Referring to FIG. 9, where the machine 40 is shown positioned at the handle loading station 116. The handle loading station 116 comprises a barrier 117 adapted to prevent the accidental lowering and operation of the actuation handle 110 of the machine 40. At the handle loading station 116, the handles 28 and 30 are inserted into the support members 42 and 60, respectively. In one embodiment, the handles 28 and 30 are formed from a continuous cord (not shown) which is, for example, placed within the channel 70 of the first end handle retention portion 64 of the second support member 60, then wrapped around the upper handle retention portion 72, then placed within the channel 70 of the second end handle retention portion 66 of the second support member 60, then placed within the channel 52 of the second end handle retention portion 48 of the first support member 42, then wrapped around the upper handle retention portion 54 the first support member 42, then placed within the channel 52 of the first end handle retention portion 46 of the first support member 60, and then cut. Thereafter, an operator manually cuts the cord at the junction of the channel 52 and channel 70 of the second end handle retention portion to thereby form both handles 28 and 30. After the insertion of handles 28 and 30, index wheel may be rotated such that the machine 40 is then positioned at the adhesive application station 120.

Figure 10:
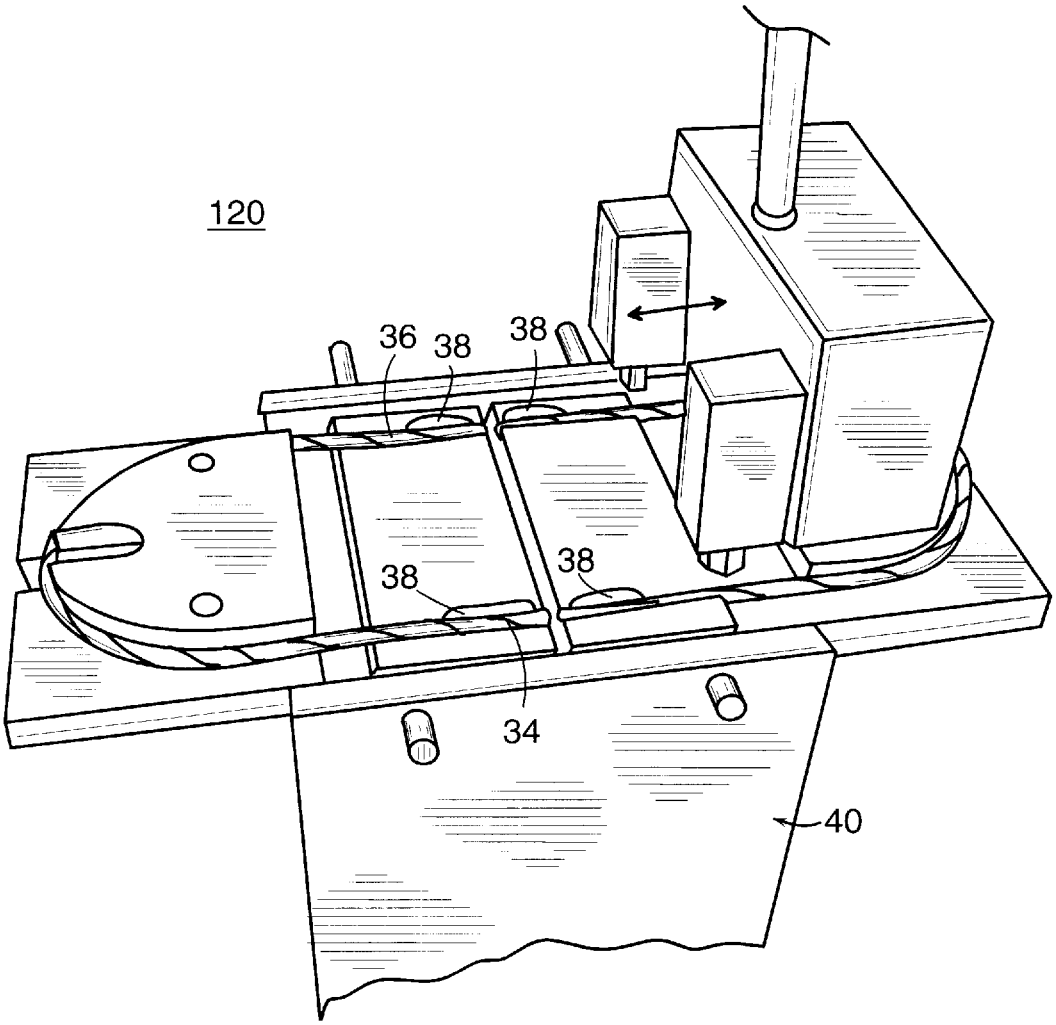
FIG. 10 is a perspective view showing the handle support machine positioned at the adhesive application station of the manufacturing system wherein an adhesive material is applied to the end portions of the first and second handle.
Figure 11:
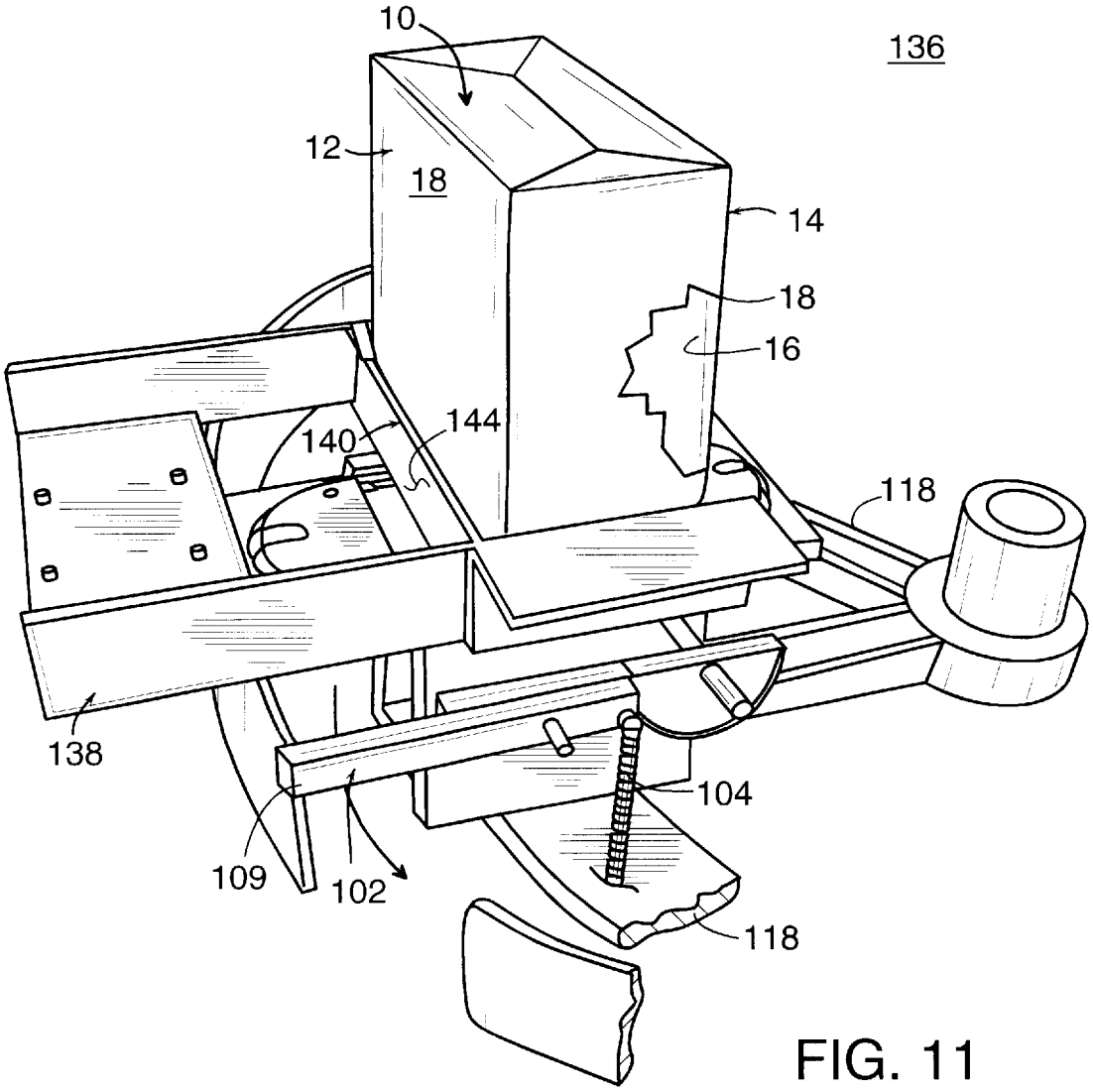
FIGS. 11–12 are perspective view showing the handle support machine positioned at the handle attachment station of the manufacturing system wherein the first and second handles may be attached to the gift box.
Figure 12:
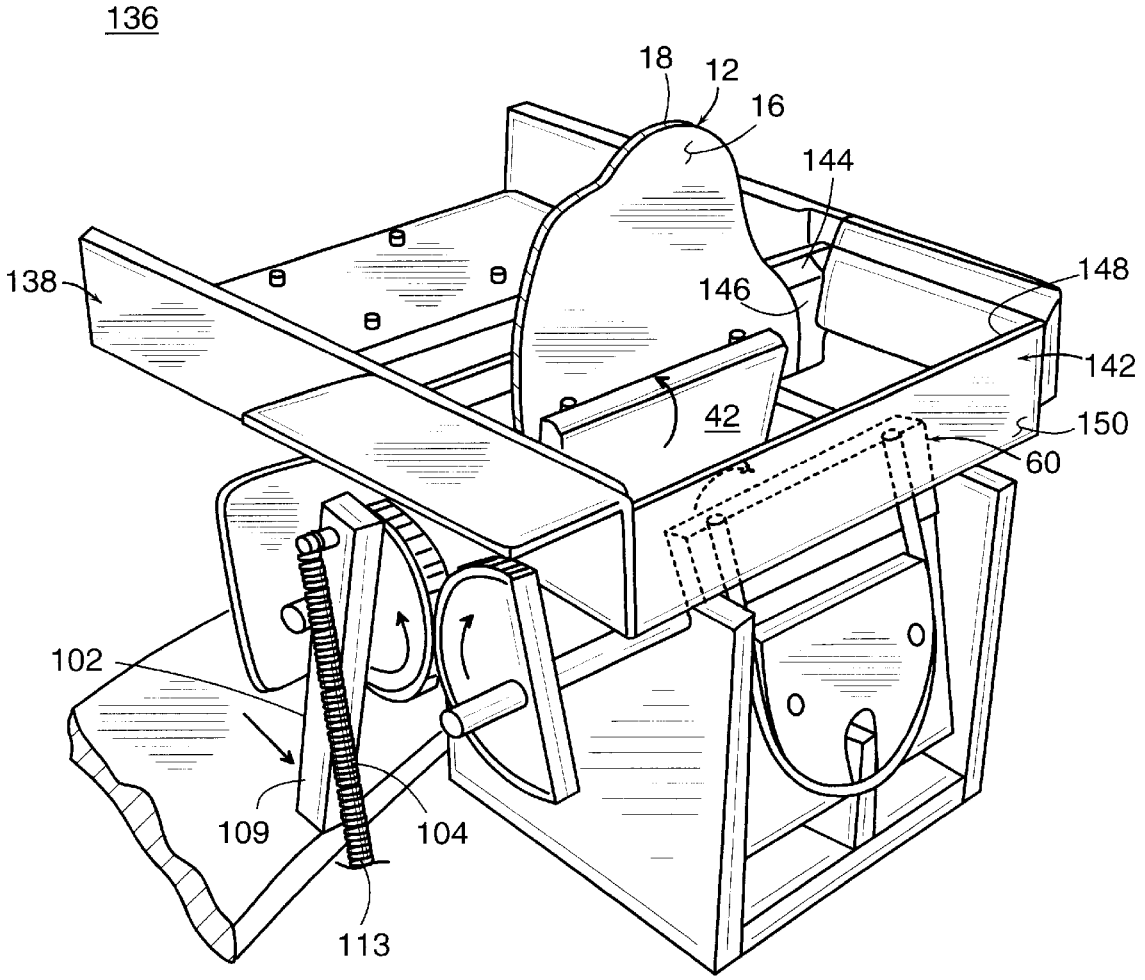

Referring to FIG. 10, where the machine 40 is shown positioned at the adhesive application station 120. The adhesive application station 120 generally comprises an adhesive machine 122 which is adapted to apply the adhesive member 38 to the ends portions 34 and 36 of the handles 28 and 30. The adhesive machine 122 is of conventional design and is controlled to move back and forth over the end portions of the handles 28 and 30 and to apply the adhesive member 38 only thereon. The adhesive application station further comprises a barrier 126 to prevent lowering of the actuation handle 110 and Referring to FIGS. 11–12, where the machine 40 is shown positioned at the handle attachment station 136. The handle attachment station 136 generally comprises a box support member 138 orientated above the machine 40 and having side plates 140 and 142. The box support member 138 is adapted to support the gift box 10 such that the outside surfaces 18 of sidewalls 12 and 14 of the gift box 10 are in substantial contact with the side plates 140 and 142, respectively. When the actuation handle 110 is lowered, the support members 42 and 60 are rotated upwards to a substantially vertical position thereby forcing the end portions 34 and 36 (having adhesive member 38 thereon) of handle 28 and 30 into contact with the inside surfaces 16 of the sidewalls 12 and 14 of the gift box 10, respectively. Concurrently, the upper portion 32 of handles 28 and 30 are brought into contact with the stop member 112 thereby ejecting the upper portion 32 of the handles 28 and 30 from the support members 42 and 60, respectively. After a short period of time (depending upon the curing time of the adhesive material 38), the actuation handle 110 is released and the spring 104 causes the the actuation handle 110 to be return to its normal position whereby the support members 42 and 60 are rotated back to their normally horizontal position. As the support members 42 and 60 rotate back to their normally horizontal positions, the end portions 34 and 36 of the handles 28 and 30 are removed from the channels 52 and 70 of the support members 42 and 60, respectively.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A machine for use in attaching first and second handles to a gift box using an adhesive material, each of the first and second handles having first and second end portions and an upper portion, said gift box having first and second inside surfaces, the machine comprising:

(a) a base member;

(b) first and second side walls extending upward from said base member;

(c) a first handle support member having a support surface adapted to retain the first handle, said first handle support member being moveably engaged with said first and second side walls; and (d) a second handle support member having a support surface adapted to retain the second handle, said first and second handle support members being operable from a first normally horizontal position wherein the first and second handles may be inserted thereon and provided with the adhesive material to a second substantially vertical position wherein the first and second handles may be attached to the gift box.

2. The machine of claim 1, wherein said first handle support member comprises a first end handle retention portion adapted to retain the first end of the first handle, a second end handle retention portion adapted to retain the second end of the first handle, and an upper handle retention portion adapted to retain the upper portion of the first handle.

3. The machine of claim 2, wherein said second handle support member comprises a first end handle retention portion adapted to retain the first end of the second handle, a second end handle retention portion adapted to retain the second end of the second handle, and an upper handle retention portion adapted to retain the upper portion of the second handle.

4. The machine of claim 3, wherein said first end handle retention portion and said second end handle retention portion of said first handle support member each comprise a channel adapted to receive the first and second end portions of the first handle.

5. The machine of claim 4, wherein said first end handle retention portion and said second end handle retention portion of said second handle support member each comprise a channel adapted to receive the first and second end portions of the second handle.

6. The machine of claim 5, wherein said each of said first and second handle support members are rotatably engaged with said first and second side walls.

* * * * *